United States Patent [19]

Hayes

[11] 4,148,540

[45] Apr. 10, 1979

[54] ELECTRICAL COUPLING DEVICES

[76] Inventor: Derek Hayes, Beckford Farm, St. Peter South, Elmham, Bungay, Suffolk NR35 INQ, England

[21] Appl. No.: 857,610

[22] Filed: Dec. 5, 1977

[30] Foreign Application Priority Data

Oct. 9, 1975 [GB] United Kingdom ..... 41489/75

[51] Int. Cl.[2] ..... H01R 13/38

[52] U.S. Cl. ..... 339/99 R

[58] Field of Search ..... 339/97–99

[56] References Cited

U.S. PATENT DOCUMENTS

| | | | |
|---|---|---|---|
| 830,675 | 9/1906 | Rosenberger | 339/97 T |
| 2,159,064 | 5/1939 | Walter | 339/99 R |
| 3,012,219 | 12/1961 | Levin et al. | 339/98 |
| 3,187,172 | 6/1965 | Knapp et al. | 339/97 L |
| 3,321,731 | 5/1967 | Goldbaum | 339/97 L |
| 3,341,802 | 9/1967 | Baldwin et al. | 339/97 L |
| 3,867,621 | 2/1975 | Gewfrtz et al. | 339/97 L |
| 3,976,350 | 8/1976 | Keglewitsch | 339/97 P |

FOREIGN PATENT DOCUMENTS

| | | | |
|---|---|---|---|
| 2503413 | 8/1975 | Fed. Rep. of Germany | 339/97 P |
| 479961 | 11/1969 | Switzerland | 339/97 R |

*Primary Examiner*—Joseph H. McGlynn
*Attorney, Agent, or Firm*—Howson and Howson

[57] ABSTRACT

An electrical coupling device which can make efficient electrical contact with the electrically conducting part or parts of one or more insulated electrical conductors without the need for baring all the insulation from the conductor or conductors and without the need for actuating with a tool some form of connection member. The coupling device includes a body portion which has an electrically insulating part and electrically conducting means which comprises metallic piercing means. The coupling device also includes a conductor-locating means which has guiding means for guiding the piercing means along a specific path in the locating means when the locating means and the body portion are assembled together in an operative position. While the conductor-locating means and the body portion are moved relative to one another along said specific path during assembly of the two parts, the piercing means is adapted to pierce the insulation of, and make electrical contact with, the electrically conducting part of an insulated electrical conductor in the locating means, and the locating means and the body portion are releasably retained in the operative position, at least when an insulated electrical conductor is located in the locating means. The coupling device is suitable for use in mains voltage systems, for example as an electric plug, ceiling rose or lamp-holder, or in low voltage systems, for example automobile wiring systems.

22 Claims, 33 Drawing Figures

ELECTRICAL COUPLING DEVICES

Figure 1:
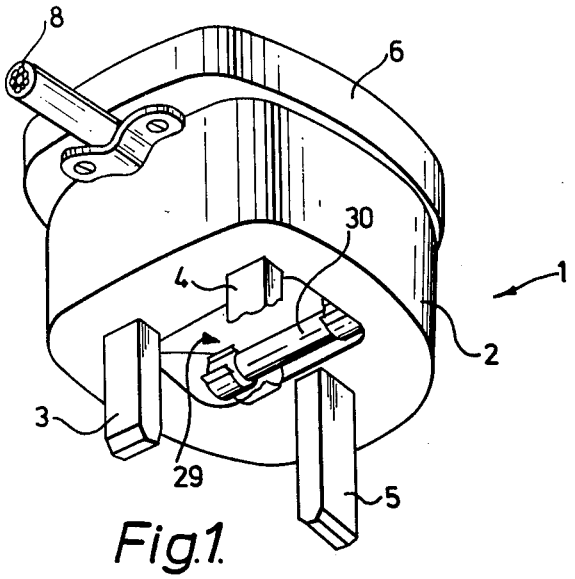

This is a continuation, of application Ser. No 730,025 filed Oct. 6, 1976, now abandoned.

The present invention relates to an electrical coupling device, and is particularly concerned with the provision of a device capable of making electrical contact with the electrically conducting part of an insulated electrical conductor.

The main aim of the invention is to provide an electrical coupling device which can make efficient electrical contact with the electrically conducting part or parts of one or more insulated electrical conductors without the need for baring all the insulation from the conductor or conductors and without the need for actuating with a tool some form of connection member, for example a terminal, in order to effect electrical connection of the electrically conducting part or parts of the conductor or conductors with one or more electrically conducting parts of the coupling device.

According to the invention an electrical coupling device comprises a body portion having an electrically insulating part and electrically conducting means comprising metallic piercing means, and conductor-locating means including guiding means for guiding said piercing means along a specific path in said locating means when the latter and the body portion are brought together into an operative position, the piercing means being adapted to pierce the insulation of, and to make mechanical and electrical contact with, the electrically conducting part of an insulated electrical conductor in said locating means whilst being guided along said path during relative movement of the conductor-locating means and body portion into said operative position, the conductor-locating means and said body portion being releasably retained in said operative position, at least when an insulated electrical conductor is located in the locating means.

Preferably, the conductor-locating means comprises a pair of jaws adapted to locate or cradle an insulated electrical conductor therebetween. The confronting surfaces of said jaws may constitute said guiding means for guiding the piercing means between said pair of jaws. Alternatively, grooves may be provided in confronting portions of the jaws to define at least one slot for guiding the piercing means between the jaws without unduly separating the latter.

Conveniently, confronting portions of the jaws may be recessed in order to define, when the jaws are brought together, either a blind or open conductor-locating slot for locating or cradling an electrically insulated conductor of a given cross-section between said jaws. A blind conductor-locating slot has the advantage that there is no chance of the bare end of the conductor being exposed when the conductor is located between the jaws. If desired, several conductor-locating slots may be provided either so that the device is able to receive any one of a range of electrically insulated conductors of different cross-sectional areas in an appropriate one of the slots or for enabling two or more electrically insulated conductors (of the same or different cross-sectional areas) located or cradled between said jaws to be pierced by said piercing means during relative movement of the pair of jaws and body portion into said operative position. The slot(s) may be arranged so as to locate an electrically insulated conductor (or conductors) either perpendicular to, or at an angle to, the direction of movement of the piercing means, is a plane between said jaws, when the piercing means is guided along said path. The slot(s) may have a tapered entry to facilitate positioning of insulated conductors therein and may be of any suitable cross-section, for example circular of polygonal. However, an oval cross-section (with its major axis parallel to the confronting surfaces of the jaws) has the advantage that it readily enables a wide range of conductor sizes to be accommodated in a single slot and also can result in deformation of a conductor so that the contact surface between the piercing means and the metallic core of the conductor is enlarged. The semi-oval recess in each jaw may have at least one small projection on its wall. When a large conductor is located between the jaws the projections would be deformed by the conductor and would become partly embedded in the insulation of the conductor. On the other, when a smaller conductor is located between the jaws, the projections would act to locate the conductor securely in a part of the oval recess. An oval cross-section of the slot(s) is also convenient if it is desired to locate or cradle more than one conductor in a slot.

The pair of jaws may be resiliently movable towards and away from each other. Alternatively, the pair of jaws may be hinged together. In either case the pair of jaws may be formed as a separate unit or may be carried by, or formed integrally with, a cover made of an electrically insulating material. Suitably the body portion comprises camming means at least partly surrounding the piercing means and serving to cooperate with said hinged or resilient jaws during relative movement of the jaws and the body portion into said operative position and to hold the jaws together in a closed position when the jaws and the body portion are in the operative position. The cooperating parts of the camming means and the pair of jaws may be dimensioned so that the hinged or resilient jaws are urged together, either positively to grip or clamp an insulated electrical conductor located between said jaws or to prevent an insulated electrical conductor located between said jaws from being moved between said jaws in a direction perpendicular to the conductor axis, before the piercing means enters between the jaws or before the piercing means penetrates an insulated electrical conductor located or cradled between the jaws, for example before the piercing means reaches a conductor-locating slot. Conveniently, the camming means comprises a pair of opposed walls of a recess in which the piercing means is located.

At least one outwardly facing surface of said pair of jaws may be provided with a projection or notch for cooperation with a corresponding notch or projection, respectively, provided in said camming means. In the case where the pair of jaws is formed as a separate unit, the camming means and pair of jaws may be provided with at least one further notch and cooperable projection to retain the jaws in a position partly removed from the camming means.

The manufacture of pairs of jaws as separate units may be facilitated by extruding a length of material having the desired cross-sectional shape and cutting off lengths therefrom to provide pairs of jaws having the desired length. In a subsequent forming operation, slots may be provided for guiding the piercing means between the jaws. The extrudate may consist of two jaws of solid cross-section joined together by a thin web serving as a hinge for the pair of jaws, in which case it may be convenient to manufacture the extrudate from a relatively soft plastics material, for example a thermoplastics material. Alternatively, the extrudate may consist of two jaws of hollow cross-section connected by a thin strip of a resilient nature so that the two jaws can be sprung apart. In this case it may be convenient to manufacture the extrudate from metallic material or a relatively hard plastics material, for example a thermosetting plastics material.

The piercing means may comprise at least one pointed pin or at least one blade. Suitably the piercing means comprises two blades arranged in co-planar relationship, the leading edge(s) of which may be shaped (for example pointed, curved, straight etc). One of the blades may be longer than the other blade.

In one particular embodiment of the invention the electrical coupling device is in the form of an electric plug having a base (forming the aforesaid body portion) carrying three metallic pins each electrically connected, or connectible, to a different piercing means, a cover, and three conductor-locating means each having an associated guiding means for guiding said piercing means along a specific path in said locating means when the latter and said base are brought together into an operative position.

Each conductor-locating means, which is preferably in the form of a pair of jaws, may be carried by, or formed integrally with, said cover.

One of the pins may be electrically connected to its associated piercing means via a removable fuse.

Cable strain-relieving means may be provided on the cover.

In another embodiment of the invention the electrical coupling device is in the form of an electric plug comprising an electrically insulating contact-carrying portion, three metallic pins carried by, and extending from, said contact-carrying portion, a different metallic piercing means electrically connected or connectible, e.g. via a fuse, to each pin, and carried by said contact-carrying portion, and a different conductor-locating means, including guide means, associated with each metallic piercing means, each piercing means being guidable, by means of said guide means, along a specific path into an operative position with its associated conductor-locating means and being releasably retainable in said operative position, at least when an insulated electrical conductor is located in the conductor-locating means.

The present invention, whilst having particular application to electrical couplings employed with mains voltage systems, is also applicable to electrical couplings employed with low-voltage systems, for example automobile wiring systems.

Figure 2:
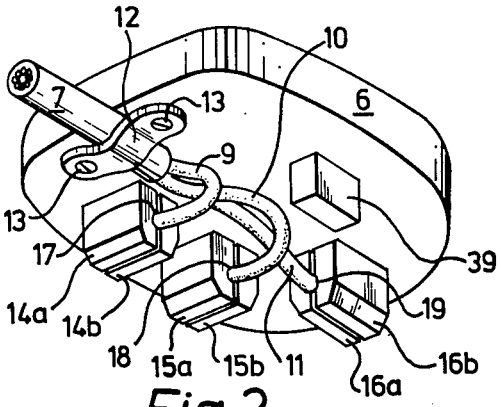
Figure 3:
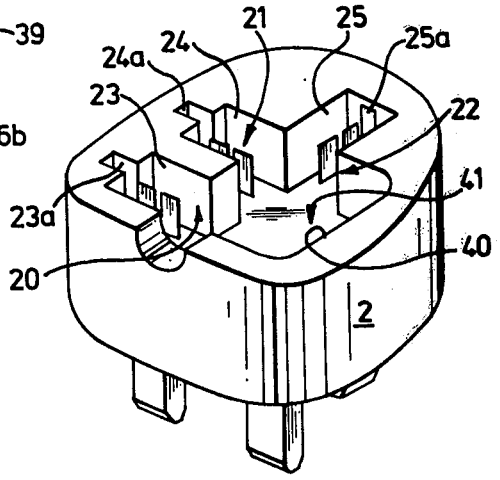
Figure 4:
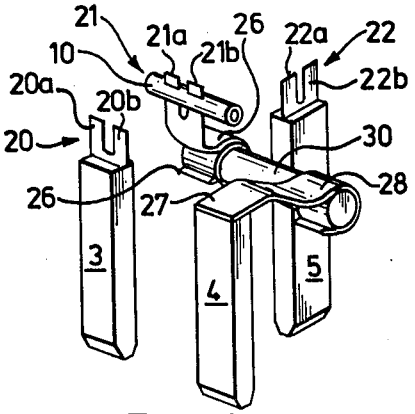
Figure 5A:
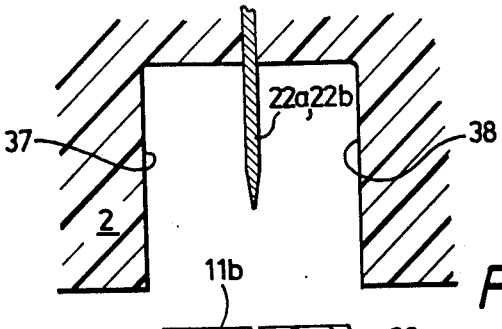
Figure 5B:
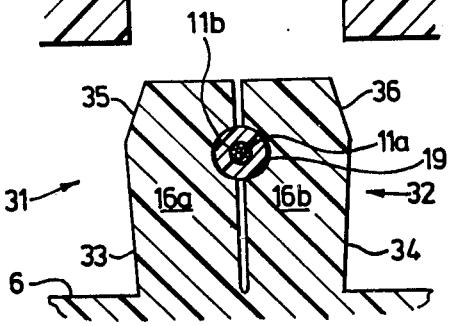
Figure 5B:
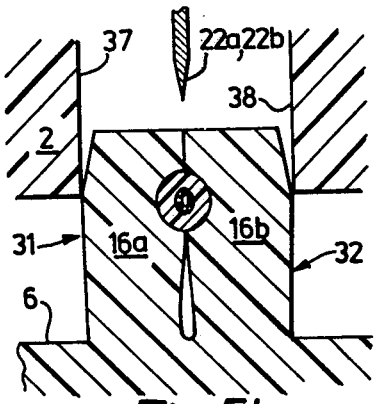
Figure 5C:
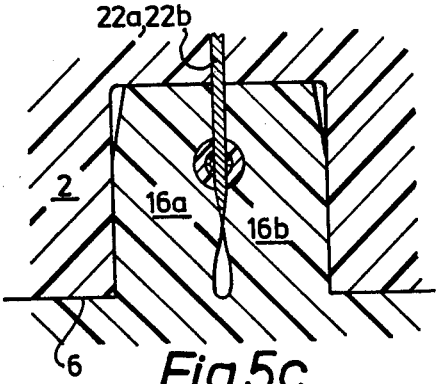
Figure 6A:
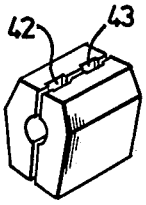
Figure 6B:
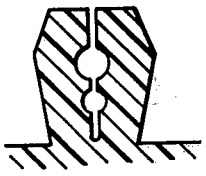
Figure 8C:
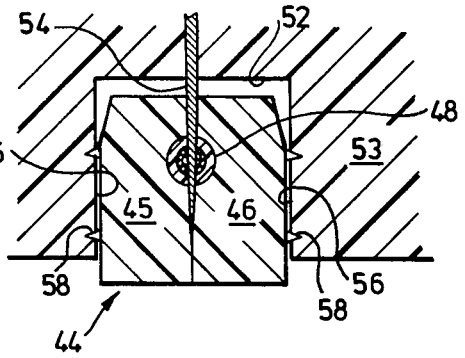
Figure 8B:
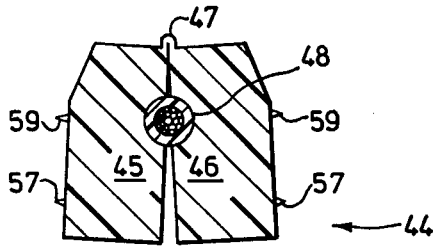
Figure 8A:
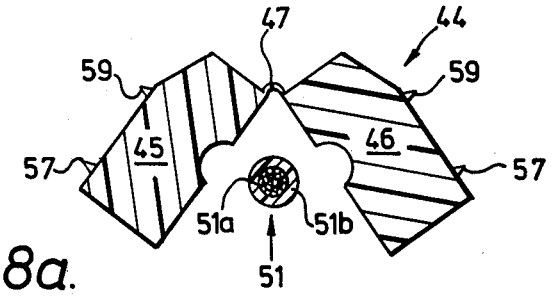
Figure 7:
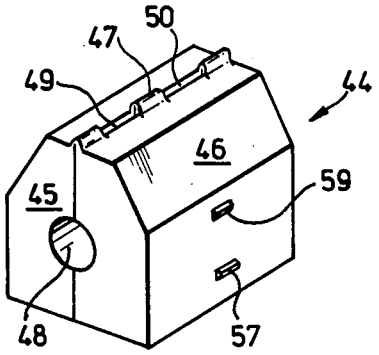
Figure 9:
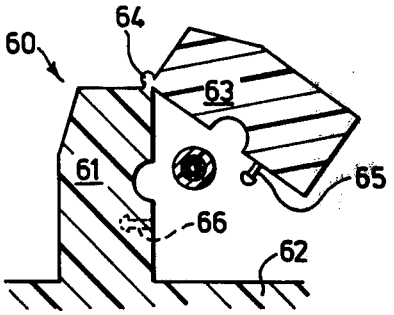
Figure 10:
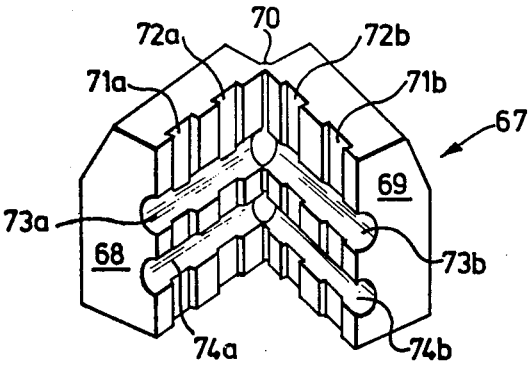
Figure 11:
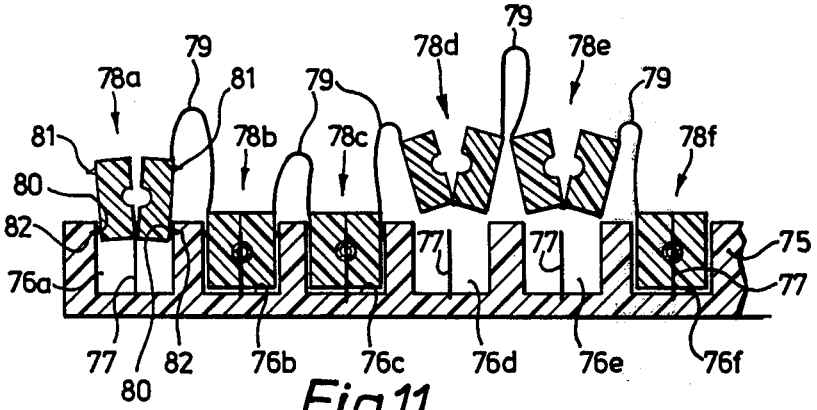
Figure 12A:
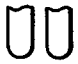
Figure 12B:
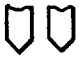
Figure 12C:
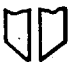
Figure 12D:
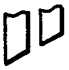
Figure 13A:
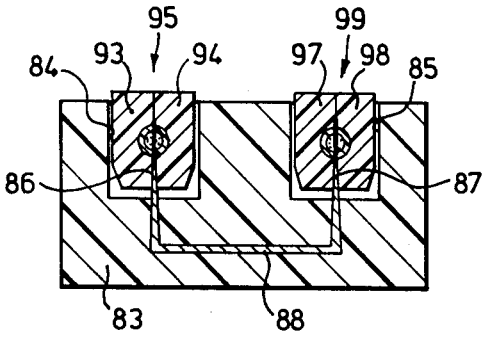
Figure 13B:
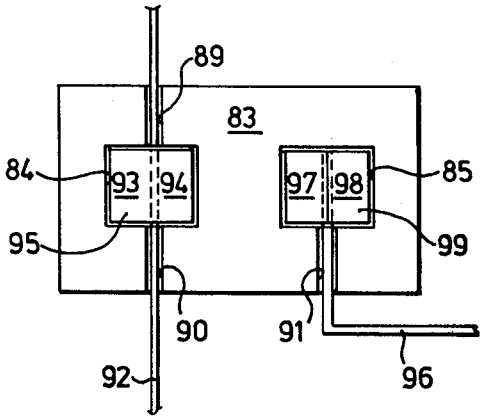
Figure 14A:
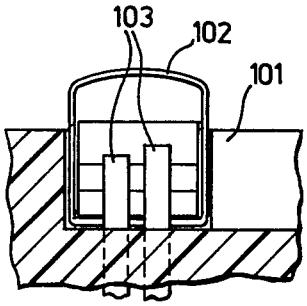
Figure 14B:
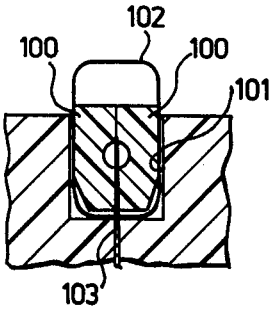
Figure 14C:
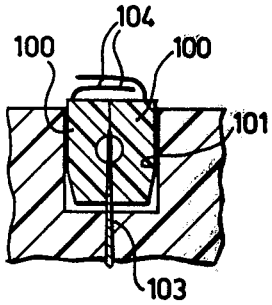
Figure 14D:
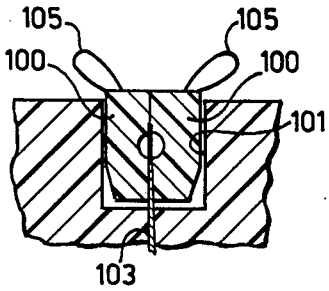
Figure 14E:
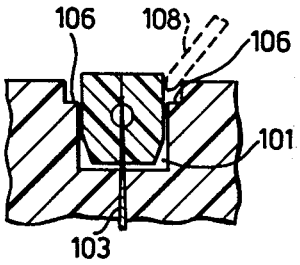
Figure 14F:
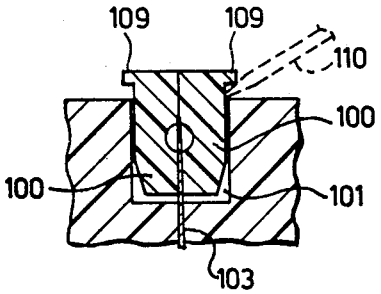
Figure 14G:
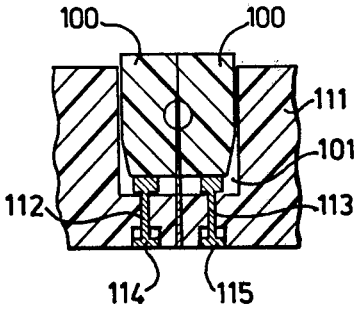
Figure 14H:
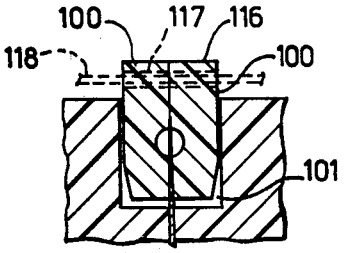
Figure 15:
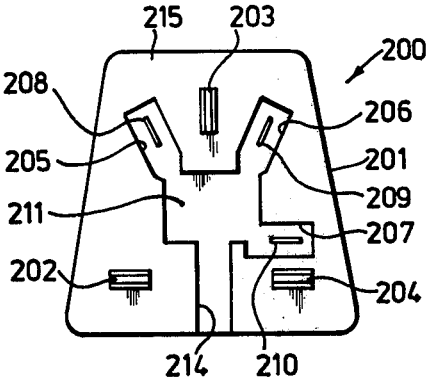
Figure 16:
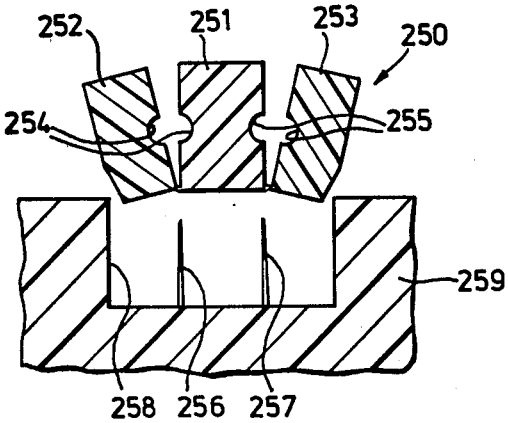
Figure 17:
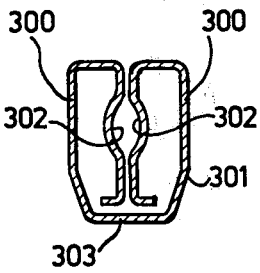

The invention will now be described, by way of example, and with particular reference to, the accompanying drawings, in which:

FIG. 1 is a perspective view from below of an electric plug according to the invention, FIG. 2 is a perspective view from below of the cover of the electric plug shown in FIG. 1, FIG. 3 is a perspective view from above of the base of the electric plug shown in FIG. 1, FIG. 4 is a perspective view from above of the terminal pins and the insulation-piercing means for the electric plug base shown in FIG. 3, FIGS. 5*a* to 5*c* show three different stages in the guiding of an insulation-piercing means between a pair of jaws during connection of the base shown in FIG. 3 to the cover shown in FIG. 2, FIGS. 6*a* and 6*b* are perspective and sectional views, respectively, of two different embodiments of a pair of jaws for clamping an electrically insulated conductor in the plug shown in FIG. 1, FIG. 7 is a perspective view of a conductor-locating means of another embodiment of a coupling device according to the invention, FIGS. 8*a* to 8*c* show three different stages in the guiding of an insulation-piercing means between the pair of jaws shown in FIG. 7, FIG. 9 is a sectional view of a conductor-locating means of a further embodiment of a coupling device according to the invention, FIG. 10 is a perspective view of a conductor-locating means of a still further embodiment of a coupling device according to the invention, FIG. 11 is a part sectional view of a terminal board for use in an automobile and illustrating a further feature of the invention, FIGS. 12*a* to 12*d* are side views of portions of various insulation-piercing means suitable for use in a coupling device according to the invention, FIGS. 13*a* and 13*b* are a sectional view and a plan, respectively, of a further embodiment of a coupling device according to the invention, FIGS. 14*a* to 14*h* are schematic sectional views of the conductor-locating means and part of the body portion of various embodiments of an electrical coupling device according to the invention, each conductor-locating means being shown in operative position in relation to its assocated body portion, and each of these Figures illustrating different means for facilitating release of the conductor-locating means from its operative position, FIG. 15 is a view from below of another embodiment of an electric plug according to the invention, FIG. 16 is a schematic sectional view of the conductor-locating means and part of the body portion of a further coupling device according to the invention, and FIG. 17 is a sectional view of yet another embodiment of a pair of jaws for locating an electrically insulated conductor in a coupling device according to the invention.

FIG. 1 shows a 13 amp, 3-pin electric plug, generally designated by the reference numeral 1, comprising a cover 6 (shown in more detail in FIG. 2) moulded from electrically insulating material, and a base 2 (shown in more detail in FIG. 3) also moulded from electrically insulating material and carrying neutral, live and earth pins 3, 4 and 5, respectively (shown in more detail in FIG. 4).

A 3-core insulated electric cable 7 with outer insulation 8 removed from one end thereof to reveal insulated neutral, live and earth wires 9, 10 and 11, is clamped to the cover 6 by means of a cable grip 12 secured to the cover by screws 13. The insulated wires 9, 10 and 11 are received between pairs of resilient jaws (14*a*, 4*b*), (15*a*, 15*b*) and (16*a*, 16*b*), respectively, moulded integrally with the cover 6, the wires being inserted into open or blind conductor-locating slots 17, 18 and 19, respectively, disposed substantially parallel to the cover 6 and defined by recesses of substantially semicircular cross-section provided in confronting portions of the jaws (14*a* and 14*b*), (15*a* and 15*b*), and (16*a* and 16*b*), respectively. At least the free end surfaces of the pairs of jaws (14*a*, 14*b*), (15*a*, 15*b*) and (16*a*, 16*b*) may be suitably coloured to correspond to the colour of the insulation surrounding the neutral, live and earth wires, respectively. In accordance with the standards at present in use in the United Kingdom, these colours for the jaws (14*a*, 14*b*), (15*a*, 15*b*) and (16*a*, 16*b*) would be light blue, brown, and yellow and green, respectively.

Metallic insulation-piercing means, generally designated by the reference numerals 20, 21 and 22, are located in recesses 23, 24 and 25, respectively, provided in the upper portion of the base 2. These insulation-piercing means may be gold plated so that they retain highly electrically conductive surfaces more or less indefinitely. Each of the insulation-piercing means comprises a pair of bifurcated, co-planar blades (20*a*, 20*b*), (21*a*, 21*b*) and (22*a*, 22*b*) of equal length. The piercing means 20 and 22 are electrically and physically connected to the pins 3 and 5, respectively. The piercing means 21 is formed from a strip of metal which is bent, at its end remote from the bifurcated blades (21*a*, 21*b*), into the shape of a clip 26. Another strip of metal 27, bent into the shape of a clip 28, is electrically and physically connected to the pin 4. The clips 26 and 28 project into a recess, generally designated by the reference numeral 29, formed in the lower portion of the base 2, for the reception of a fuse 30. When the fuse 30 is inserted in the clips 26 and 28 in the recess 29, electrical contact is made between the pin 4 and the bifurcated blades (21*a*, 21*b*). A cover (not shown) may be provided over the opening of the recess 29 to conceal the fuse 30.

Electrical contact between the pins 3, 4 and 5 and the insulated wires 9, 10 and 11, respectively, is made by bringing together the separated base 2 and cover 6 in such a manner that the blades (20*a*, 20*b*), (21*a*, 21*b*) and (22*a*, 22*b*) enter between and are guided by their respective pairs of jaws (14*a*, 14*b*), (15*a*, 15*b*) and (16*a*, 16*b*). As the base and cover are brought together in this way, the pairs of blades (20*a*, 20*b*), (21*a*, 21*b*) and (22*a*, 22*b*) pierce the insulation of the wires 9, 10 and 11, respectively, and make electrical contact with the conducting parts of these wires. FIGS. 5*a*, 5*b* and 5*c* show in detail how the blades (22*a*, 22*b*) pierce the insulation of the earth wire 11 during the bringing together of the base 2 and cover 6. As can be clearly seen in FIG. 5*a*, the jaws 16*a* and 16*b* extend from the cover 6 in such a manner that the outwardly-facing surfaces 31 and 32 firstly diverge away from each other along the portions 33 and 34, respectively, and then coverge towards each other along the portions 35 and 36, respectively. The earth wire 11, having a multi-strand core 11*a* surrounded by insulation 11*b* is located between the resilient jaws 16*a* and 16*b* in the slot 19. On movement of the base 2 and cover 6 towards each other, parallel side walls 37 and 38 of the recess contact the portions 35 and 36 of the surfaces 31 and 32, respectively. Further movement towards each other of the base 2 and cover 6 causes the jaws (16*a*, 16*b*) to be urged together, thereby closing the gap between the jaws and preventing movement of the earth wire 11 between the jaws perpendicular to the axis of the wire 11. Preferably the wire 11 is clamped by the jaws in the slot 19 (as shown in FIG. 5*b*) but this is not essential. The pressure of the jaws (16*a*, 16*b*) against the wire 11 increases until the side walls 37 and 38 reach the position where the "converging" portions 35 and 36 meet the "diverging" portions 33 and 34, respectively, of the surfaces 31 and 32, respectively (as shown in FIG. 5*b*). On continued movement of the base 2 and cover 6 towards each other, the blades (22*a*, 22*b*) are guided between the jaws (16*a*, 16*b*) so as to pass completely through the wire 11 (see FIG. 5*c*). In passing through the wire 11, the insulation 11*b* is pierced and electrical contact made with the multi-strand core 11*a*.

It should be realised that during the bringing together of the base 2 and cover 6, the blades (20*a*, 20*b*) and (21*a*, 21*b*) are guided between the jaws (14*a*, 14*b*) and (15*a*, 15*b*), respectively, to make electrical contact with the cores of the live and neutral wires 9 and 10, respectively, in a manner similar to that described for the blades (22*a*, 22*b*) and jaws (16*a*, 16*b*). It will also be realised that the base 2 and cover 6 should be correctly aligned when they are brought together. If necessary, a guide 39 integral with the cover 6 may be provided to assist this alignment by engaging against a wall 40 defining a recess generally designated by the reference numeral 41, in the base 2. Conventional securing means (not shown) are provided for securing the base 2 to the cover 6.

In the plug of FIGS. 1 to 4, the conductor-locating slots 17, 18 and 19 may be blind slots, so that the free ends of the wires 9, 10 and 11 do not project from the ends of the pairs of jaws when the wires are located in the slots. If, however, the slots 17, 18 and 19 are open at both ends the free ends of the wires 9, 10 and 11 may project slightly from the ends of the pairs of jaws. In FIG. 3 each of the recesses 23–25 is shown as comprising an auxiliary recess 23*a*–25*a* into which the projecting free ends of the wires 9, 10 and 11, respectively, can enter when the plug is assembled together. These auxiliary recesses 23*a*–25*a* may be open at their upper ends, as indicated for the auxiliary recesses 23*a* and 24*a*, or they may be closed at their upper ends, as indicated for the auxiliary recess 25*a*. It will be appreciated that when auxiliary recesses closed at their upper ends are provided, the free ends of the wires 9–11 will be completely surrounded by insulating material of the base 2 when the plug is assembled together.

FIG. 6*a* and 6*b* shon different examples of pairs of jaws which may be formed integrally with, or carried by, the cover 6. In FIG. 6*a* a pair of parallel slots 42 and 43 are shown arranged substantially perpendicular to the conductor-locating slot. The blades of each piercing means are received in the slots 42 and 43 which serve to prevent pressure (i.e. clamping or positioning pressure) being taken off the conductor, retained in the conductor-locating slot, by a wedging action of the blades serving to separate the jaws. In FIG. 6*b* a pair of jaws is shown having two conductor-locating slots for locating insulated conductors of different sizes. Of course, any number of conductor-locating slots may be provided. Also the conductor-locating slots may be inclined (i.e. not parallel as shown) to the cover. Furthermore the entry end of each conductor-locating slot may be flared to facilitate the insertion of a conductor into the slot.

The electric plug described with reference to FIGS. 1 to 4 and FIGS. 5*a* to 5*c* illustrates one form of electric coupling device according to the invention suitable for use in mains voltage systems. It should be realised however that the invention is intended to cover other mains voltage coupling devices, for example ceiling roses, lamp holders and other devices in which it is required to make electrical connection to one or more insulated electrical conductors. In particular the invention is applicable to the electric coupling of supply leads to domestic or industrial appliances. However, as will be described hereinafter, the invention is also applicable to electric couplings employed in low voltage systems, for example automobile wiring systems.

Although the present invention is intended to cover a coupling device having a conductor-locating means which is not in the form of a pair of jaws which are movable towards and away from each other, it is at present preferred that the conductor-locating means should be in the form of a pair of relatively movable jaws. One reason for this is that the positioning of an insulated conductor between the jaws is facilitated if the jaws are separable. Furthermore, the removal of the conductor from between the jaws is deterred or prevented if the jaws are subsequently closed together either positively to grip or clamp the insulated conductor or merely to bring the confronting surfaces of the jaws into physical contact (for example when the conductor is retained in a conductor-locating slot of greater diameter than the conductor). The coupling device of FIGS. 1 to 4 incorporates a pair of jaws resiliently movable towards and away from each other. However, the pair of jaws may, instead, be hinged together as will be described hereinafter.

FIG. 7 shows a separate, conductor-locating means, generally designated by the reference numeral 44, comprising a pair of jaws 45 and 46 integrally connected by a hinge 47. The conductor-locating means 44 has a conductor-locating slot 48 and a pair of slots 49 and 50 for guiding piercing-means between the jaws 45 and 46. In use, the jaws 45 and 46 are opened and the end of a conductor 51, having a multi-strand core 51*a* surrounded by insulation 51*b*, is positioned between the jaws 45 and 46 (see FIG. 8*a*). The jaws 45 and 46 are then closed so as to locate the conductor 51 in said conductor locating slot 48 (see FIG. 8*b*). Finally the conductor-locating means 44 is pressed into a recess 52 provided in a block 53 of electrically insulating material and having a pair of co-planar metallic blades 54 mounted centrally therein (see FIG. 8*c*, in which only one of the blades 54 can be seen). In pressing the conductor-locating means 44 into the recess 52, the blades 54 are guided in the slots 49 and 50, pierce the insulation 51*b* and make mechanical and electrical contact with the core 51*a*. The recess 52 has opposite walls 55 and 56 which act as camming surfaces and press the jaws 45 and 46 together into a fully closed position against the resilience of the conductor 51 located in the slot 48. The resilience of the conductor 51 provides a force tending to separate or open the jaws 45 and 46. This separating force serves to retain the conductor-locating means 44 in the recess 52 when fully pressed into the latter. Additionally, a rib 57 may be provided on each jaw 45, 46 for location in recesses 58 provided in walls of the recess 52 when the conductor-locating means 44 is fully pressed into the recess 52. A further rib 59 may also be provided on each jaw 45, 46 for location in the recesses 58 when the conductor-locating means 44 has been partially withdrawn from the recess 52. In this partially withdrawn position (not shown), the jaws 45, 46 remain captive in the block 53 but may be opened a sufficient distance to allow an insulated conductor to be removed from, or positioned, between the jaws 45, 46.

It will be appreciated that the block 53 may be a terminal block in an electrical appliance, the blades 54 being connected to an electrical device in the appliance. Again, the conductor-locating means of FIG. 7 may be employed with the base of an electric plug similar to that shown in FIG. 3. In this case three conductor-locating means of the kind shown in FIG. 7 would be inserted into the recesses 23, 24 and 25. When inserted into the recesses, the conductor-locating means could be retained in position by a cover plate secured to the base 2 by any convenient means.

FIG. 9 shows a further example of electrically insulating, conductor-locating means, generally designated by the reference numeral 60, comprising a first jaw 61 integrally formed with a cover 62, and a second jaw 63 integrally connected to the first jaw 61 by means of a hinge 64. A projection 65 formed on the jaw 63 is receivable in a recess 66 in the first jaw 61 to releasably retain the pair of jaws in a closed position. One or more slots (not shown) would be provided for guiding insulation-piercing means between the first and second jaws.

Conductor-locating means of the kind shown in FIG. 9 may be incorporated in the electric plug of FIGS. 1 to 4, the pairs of jaws (14*a*, 14*b*), (15*a*, 15*b*) and (16*a*, 16*b*) each being replaced by a pair of jaws 61, 63. In this case the jaws 61 would be formed integrally with the cover 6.

FIG. 10 shows a further example of a conductor-locating means made of electrically insulating material and generally designated by the reference numeral 67. The conductor-locating means 67 comprises a pair of jaws 68 and 69 integrally connected by means of a hinge 70 extending along one side of the conductor-locating means 67 (c.f. FIG. 7 in which the hinge 47 extends along one end of the conductor-locating means 44). The inwardly facing surface of the jaw 68 is provided with a pair of recesses (71*a*, 72*a*) parallel to the hinge 70, and a pair of recesses (73*a*, 74*a*) substantially perpendicular to the hinge 70. Similarly the inwardly-facing surface of the jaw 69 is provided with a pair of recesses (71*b*, 72*b*) parallel to the hinge 70, and a pair of recesses (73*b*, 74*b*) substantially perpendicular to the hinge 70. When the jaws 68 and 69 are brought together into a closed position (not shown), the recesses (71*a*, 71*b*) and (72*a*, 72*b*) define a pair of guides for insulation-piercing means (not shown) in the form of a pair of blades and the recesses (72*a*, 73*b*) and (74*a*, 74*b*) define a pair of conductor-locating slots. The provision of two or more conductor-locating slots enables conductors of different sizes to be located between the jaws or, alternatively, enables two or more conductors to be located between the jaws at the same time and be pierced by insulation-piercing means.

The conductor-locating means of FIG. 10 may be employed in the same way as the conductor-locating means of FIG. 7.

In FIG. 11 there is shown a terminal board 75 made of electrically insulating material and adapted to be mounted in an automobile (not shown). The terminal board 75 comprises a plurality of spaced-apart recesses 76*a*–76*f* arranged in a line, each recess having an insulation piercing means, in the form of a blade 77, mounted therein. A plurality of spaced-apart electrically insulating, conductor-locating means, generally designated by the reference numeral 78*a*–78*f*, are connected together in a line by means of electrically insulating connecting pieces 79. Each conductor-locating means 78*a*–78*f* is constructed in a similar manner to the conductor-locating means shown in FIGS. 7 and 8*a* to 8*c*. The conductor-locating means shown in FIG. 11 may be provided with ribs 80 and 81 (as shown on conductor-locating means 78*a*) for reception in recesses 82 (shown in the recess 76*a*) for the purpose described with reference to FIGS. 7 and 8*a* to 8*c*. The recesses 76*a*–76*f* are also constructed in a similar manner to the recess 52 described with reference to FIG. 8*c*.

A plurality of conductor-locating means shown in FIG. 11, and their connecting pieces 79, may be moulded integrally from plastics material in a strip from which a length, comprising the desired number of conductor-locating means, may be cut to suit the number of recesses in the terminal board 75. The connecting pieces 79 suitably have such a length that one conductor-locating means may be withdrawn partially or completely from its recess without disturbing the other conductor-locating means (see for example the conductor-locating means 78*a*). Although not shown in FIG. 11, each of the connecting pieces 79 may have a hole therein which is a push-fit over an upwardly-directed stud positioned between adjacent recesses 76*a*–76*f* on the upper surface of the terminal board to retain the "strip" of jaws in close proximity to the terminal board when the jaws are disengaged from their recesses.

FIGS. 12*a* to 12*d* show examples of the shaping of the free ends of different insulation-piercing means suitable for use in the couplings described above, each comprising a pair of blades positioned substantially in the same plane. Of course, the number and/or width of the blades of each piercing means is chosen to suit the current-carrying capacity of the coupling device. In FIGS. 12*a*, 12*b* and 12*c* the two blades are of equal length and pierce the insulation of a conductor simultaneously. In FIG. 12*d* one blade is longer than the other so that one blade pierces the insulation before the other blade.

In FIG. 15 there is shown an electric plug 200 that needs no cover. The plug 200 comprises a contact-carrying portion 201 made of electrically insulating material and carrying three metallic pins 202, 203 and 204 which extend from one face 215 thereof. Each of the pins is associated with a recess 205, 206 and 207, respectively, in the contact-carrying portion, within which recesses there are located metallic insulation-piercing means 208, 209 and 210, respectively, connected (or connectible via a fuse, not shown) to the pins 202, 203 and 204, respectively. Each of the recesses 205–207 opens into the face 215 of the contact-carrying portion from which the pins 202–204 extend. In the face 215 there is a central recess 211 into which the recesses 205–207 opens and into which also opens a main channel 214 for a 3-core electric cable (not shown). A conductor-locating means (not shown), in the form of a pair of resilient or hinged jaws (for example of the kind shown in FIG. 7), is associated with each of the recesses 205–207. Each pair of jaws may be separate from the contact-carrying portion 201 or may be connected thereto by a flexible strip of plastics material.

Each of the conductor-locating means is movable into its associated recess 205, 206, 207 enabling the insulation-piercing means 208–210 to pierce the insulation of, and make electrical contact with, the electrically conducting part of a conductor (not shown) located in the conductor-locating means. When fully inserted into their associated recesses, the conductor-locating means are suitably flush with the face 215 of the contact-carrying portion 201. The conductor-locating means may be provided with ribs for location in corresponding notches in the associated recesses 205–207. Cable strain-relieving means (not shown) may also be provided.

The invention has so far been described with reference to coupling devices in which it is required to make electrical connection to the termination of one or more insulated electrical conductors. However it should be realised that the invention is also applicable to coupling devices for making a T-connection to an insulated electrical conductor.

In FIG. 13*a* and 13*b* there is shown an electrically insulating block 83 having two recesses 84 and 85 therein. The opposite ends 86 and 87 of metallic insulation-piercing means 88 are mounted, respectively, in the recesses 84 and 85. Grooves 89 and 90 are provided in the block 83 and communicate with the recess 84. A further groove 91 in the block 83 communicates with the recess 85. T-connection to an insulated electrical conductor 92 is made by locating the conductor, intermediate its ends, between the hinged jaws 93 and 94 of a conductor-locating means 95 (similar to the conductor-locating means 44 shown in FIG. 7) and pressing the conductor-locating means 95 into the recess 84 so that the insulation of the conductor 92 is pierced by the end 86 of the insulation-piercing means 88 and electrical connection is made with the core of the conductor. Portions of the conductor 92 on either side of the pierced portion thereof are received in the grooves 89 and 90. Another insulated electrical conductor 96 is electrically connected to the conductor 92 by locating an end of the conductor 96 between the hinged jaws 97 and 98 of conductor-locating means 99 (similar to the conductor-locating means 44 shown in FIG. 7) and pressing the conductor-locating means 99 into the recess 85 so that the insulation of the conductor 96 is pierced by the end 87 of the insulation-piercing means 88 and electrical connection is made with the core of the conductor 96. A portion of the conductor 96 adjacent its end, is received in the groove 91.

An alternative method (not shown) of making a T-connection (or of joining together the free ends of two conductors) is to provide a pair of conductor-locating slots in a single conductor-locating means (i.e. one slot for each conductor). The insulation-piercing means is then made of such a length that it will pass through both of the conductors located in the conductor-locating means. Alternatively, as previously mentioned, a single conductor-locating slot (for example one of oval cross-section) may be provided which is capable of receiving two conductors in superimposed relationship. Again, in this case, the insulation-piercing means is made of such a length that it will pass through both of the conductors located in the single slot.

In cases where the body portion of an electric coupling device according to the invention is provided with camming means which cooperates with a pair of jaws to hold the latter in closed position when the jaws and the body portion are in their operative position, it may be advantageous to provide means to facilitate withdrawal of the pair of jaws from the body portion. In the embodiment shown in FIGS. 1 to 4, the jaws (14*a*, 14*b*), (15*a*, 15*b*) and (16*a*, 16*b*) are formed integrally with the cover 6. Since the cover 6 can easily be grasped by a user's hand, there is no great problem involved in withdrawing the jaws from the recesses 23, 24 and 25. However, withdrawal may be facilitated by means of a wedge (not shown) insertable between the confronting surface of the cover 6 and base 2, or ejection rods (not shown) positioned between the jaws and actuable by means of a push-button positioned on the lower side (with reference to FIG. 3) of the base 2, to enable withdrawal of the pairs of jaws. Again, in the embodiment of FIG. 11, the strip 79 can be used to facilitate withdrawal of the jaws from the board 75.

The problem of withdrawal of a pair of jaws is, however, more pronounced in cases where the pair of jaws is not connected to a cover which is removable from the body portion, or formed as one of a plurality of pairs of jaws linked together by a strip as in FIG. 11. FIGS. 14*a*–14*h* show schematically various different ways in which withdrawal of a pair of jaws 100 from a recess 101 may be effected.

In FIGS. 14*a* and 14*b* a continuous loop 102 of strong flexible plastics material surrounds the jaws 100, the loop passing around the ends of the jaws in the embodiment of FIG. 14*a* and around the sides of the jaws in the embodiment of FIG. 14*b*. When assembling the jaws 100 in the recess 101 care must, of course, be taken to see that the loop 102 is positioned so that it is not cut by the conductor-piercing means 103 located in the recess. The loop 102 is of sufficient length to enable a user's finger to be inserted therethrough when it is desired to pull the jaws from the recess. In the case where several pairs of jaws are linked together, a continuous loop similar to the loop 102 may surround all the pairs of jaws.

FIG. 14*c* shows a flexible cord 104 of plastics material connected (for example integrally moulded with) each of the jaws 100, by means of which the jaws can be pulled from the recess 101. The free ends of the two cords 104 may be provided with connection means (not shown) by means of which they can be connected together to form a loop prior to withdrawal of the jaws. FIG. 14*d* shows shows a separate loop 105 connected to (for example integrally moulded with) each of the jaws 100.

In FIG. 14*e* the recess 101 is provided with a groove 106 along at least one side of the recess at its upper open end to permit the insertion of a tool (for example the blade 108 of a screwdriver, shown in dotted lines) in order to prise the jaws 100 from the recess. Alternatively, each of the jaws 100 may be provided with a flange 109, as shown in FIG. 14*f*, to enable the insertion of a tool (for example the blade 110 of a screwdriver shown in dotted lines), to lever the jaws 100 out of the recess 101.

FIG. 14*g* shows a pair of ejection-rods 112, 113 which are positioned in a body portion 111. The rods 112, 113 are connected at their lower ends to push-buttons 114, 115, respectively, which can be depressed to eject the pair of jaws 100 from the recess 101.

In FIG. 14*h* the pair of jaws 100 has a top portion 116 which projects from the recess 101 when the jaws have been inserted fully into the recess. This top portion 116 may be gripped by a user's fingers or by a clamp when it is desired to withdraw the jaws from the recess. In addition, the top portion 116 may be provided with a through-hole 117 (shown in dotted lines) through which a lifting bar 118 (also shown in dotted lines) may be inserted to facilitate the withdrawal.

It must be realised that FIGS. 14*a* to 14*h* only illustrate some of the possible ways of facilitating the removal of a pair of jaws from a recess. Other methods (e.g. the use of a wedge beneath a pair of jaws) have not been illustrated.

In all of the embodiments of coupling devices described above in which a pair of hinged jaws are closed around an electrically insulated conductor by moving them against a camming means (e.g. the walls of a recess), it will be appreciated that quite a considerable force may have to be exerted on the jaws, in order to develop the necessary clamping pressure on the conductor, in addition to the force which has to be exerted to push the piercing means through the conductor. It may therefore be advantageous to so shape and dimension the jaws, the camming means and the piercing means that the conductor clamping phase is completed before the piercing means commences to penetrate the conductor.

In all of the embodiments of the invention described above with reference to the drawings, a single conductor is, or a plurality of superimposed conductors are, located in a conductor-locating means. It is also within the scope of the invention for a conductor-locating means to receive a plurality of insulated electrical conductors in spaced-apart, side-by-side relationship, each of which is pierced by a different metallic piercing means when the conductor-locating means and the body portion are brought together into the operative position. Such an arrangment is illustrated schematically in FIG. 16. This Figure shows a conductor-locating means 250 formed as a single unit consisting of a central portion 251 and two wing portions 252, 253, each of these wing portions being hinged to the central portion 251 to define two pairs of hinged jaws. Each pair of jaws is provided with a slot 254, 255, respectively, for the reception of an insulated conductor (not shown) and with further slots (not shown, but similar to the slots 42, 43 of FIG. 6*a*) for guiding piercing means 256, 257 positioned in a single recess 258 in a body portion 259 when the locating-means 250 is pushed into the recess.

All of the jaws in the embodiments of the coupling device described above with reference to the drawings have been shown as having a solid cross-section. Such jaws are conveniently made by moulding or extrusion processes. FIG. 17 shows an alternative jaw construction which may be employed with any of the coupling devices previously described. The pair of jaws 300 shown in FIG. 17 are of hollow cross-section, being made from a single strip 301 of, for example, thermosetting plastics material or metallic material. Conveniently, the strip 301 is extruded in the shape shown in FIG. 17, which comprises recesses 302, for example of semi-oval cross-section, which form the conductor-locating slot of the pair of jaws. When it is desired to insert an insulated conductor (not shown) into the pair of jaws 300, the latter may be sprung apart owing to the resilience of the web portion 303 of the strip 301 which connects the two jaws together. It will, of course be appreciated that this web portion 303 must be provided with apertures (not shown) through which the piercing means of the coupling device can pass.

In use of the pair of jaws shown in FIG. 17, the hollow interior of the jaws may serve as a recess for the reception of suitably positioned projections provided on the wall of the recess into which the pair of jaws is inserted, for the purpose of retaining the pair of jaws in the recess when the jaws are fully pressed into the recess. An endless loop of plastics material, similar to the loop 102 of FIGS. 14*a* and 14*b* may be threaded through the hollow interior of the jaws 300 for the purpose of facilitating withdrawal of the jaws from the recess. Alternatively, the jaws 300 may be prised from the recess using a tool (for example the blade of a screwdriver) engaged in the hollow interior of the jaws.

In the various coupling devices described above, the conductor-piercing means must, of course, be of a size which is adequate to carry the maximum current which is to flow through the device in normal use. If, in the case of heavy duty coupling devices, this would require the use of a piercing means of such a large size that it would be difficult to force the piercing means through an insulated conductor, then the conductor-piercing means may be divided into two or more parts (for example as shown in FIG. 12*d*) which pierce the conductor one after the other as the conductor-locating means is moved to the operative position. Alternatively, there may be two or more conductor-locating means through which the same conductor passes in turn, each conductor-locating means being associated with a different conductor piercing means which share the current load in use of the coupling device.

What is claimed is:

1. An electrical coupling device, comprising:

a body portion comprising an electrically-insulating part having a recess in its surface, and electrically conductive metallic piercing means extending from the bottom of said recess outwardly toward its piercing end generally along the direction of the adjacent sides of said recess but laterally spaced therefrom;

conductor-locating means comprising a pair of cooperating jaws movable relative to each other and having first mutually confronting surfaces intermediate first and second ends of the jaws configured to receive between them an insulated electrical conductor and to grasp said conductor when said jaws are urged together, at least part of the opposed outer surfaces of said pair of jaws being configured to fit slidably into said recess, and guiding means incorporated in said jaws for receiving said piercing means and for slidably contacting and guiding said piercing means through said jaws and into the center of said conductor when said first end of said jaws is inserted in and advanced into said recess, said guiding means comprising second mutually confronting surfaces of said jaws extending between said first confronting surfaces of said jaws and said first end of said jaws and aligned with said piercing means when said first end of said jaws is advanced into said recess, whereby said piercing means is guided between said second confronting surfaces into operative position with the piercing means piercing the center of said conductor;

the outer surfaces of said pair of jaws and the inner surfaces of said recess being configured to produce a camming action such that inserting and advancing said jaws into said recess urges said jaws together to grasp said conductor prior to the piercing of the insulation on said conductor and during piercing of said conductor by said piercing means, and such that said jaws are thereafter releasably retained in said recess.

2. An electrical coupling device according to claim 1, in which grooves are provided in said second mutually confronting surfaces of the jaws to define at least one slot for guiding the piercing means between the jaws without unduly separating the latter.

3. An electrical coupling device according to claim 1, in which the jaws of said pair of jaws are hinged together.

4. An electrical coupling device according to claim 1, in which the piercing means comprises at least one pointed pin.

5. An electrical coupling device according to claim 1, in which said first mutually confronting surfaces of said jaws are recessed to define, when said jaws are closed together, a conductor-locating slot.

6. An electrical coupling device according to claim 5, in which said conductor-locating slot is closed at one end.

7. An electrical coupling device according to claim 5, in which at least two conductor-locating slots are provided whereby the device is able to receive any one of a range of electrically insulated conductors of different cross-sectional areas in an appropriate one of said slots.

8. An electrical coupling device according to claim 5, in which at least two conductor-locating slots are provided whereby two or more electrically insulated conductors of the same or different cross-sectional areas located between said jaws may be pierced by said piercing means during relative movement of said pair of jaws into said recess.

9. An electrical coupling device according to claim 5, in which the conductor-locating slot is arranged so as to locate an electrically insulated conductor perpendicular to the direction of advance of the piercing means, relative to said jaws, when the piercing means is guided between said second confronting surfaces.

10. An electrical coupling device according to claim 5, in which the conductor-locating slot has an oval cross-section, the major axis of the cross-section being substantially parallel to said first confronting surfaces of the jaws.

11. An electrical coupling device according to claim 1, in which the jaws of said pair of jaws are resiliently movable towards and away from each other.

12. An electrical coupling device according to claim 11, in which the pair of jaws is formed as a separate unit.

13. An electrical coupling device according to claim 11, in which at least one jaw of said pair of jaws is formed integrally with a cover made of electrically-insulating material.

14. An electrical coupling device according to claim 11, in which said body portion includes camming means at least partly surrounding said piercing means and serving to cooperate with said jaws during relative movement of the jaws and the body portion into said operative position and to hold the jaws together when the jaws and the body portion are in the operative position.

15. An electrical coupling device according to claim 14, in which said body portion includes a plurality of said camming means, each at least partly surrounding an associated piercing means, a separate pair of jaws being provided for each camming means.

16. An electrical coupling device according to claim 15, in which said pairs of jaws are connected together in a row.

17. An electrical coupling device according to claim 14, in which at least one outwardly-facing surface of the pair of jaws is provided with a projection or notch for cooperation with a corresponding notch or projection, respectively, provided in the camming means, in order to retain the jaws in said operative position.

18. An electrical coupling device according to claim 17, in which the camming means and said pair of jaws are provided with at least one further notch and cooperable projection to retain the jaws in a position partly removed from the camming means.

19. An electrical coupling device according to claim 1, in which the piercing means comprises at least one blade.

20. An electrical coupling device according to claim 19, in which the piercing means comprises two blades arranged in co-planar relationship.

21. An electrical coupling device according to claim 20, in which one of said two blades is longer than the other.

22. An electric plug comprising:

an electrically-insulating contact-carrying portion having three recesses in its surface, and, from the bottom of each recess, a metallic piercing member extending outwardly towards its piercing end generally along the direction of, but spaced from, the adjacent sides of the recess, each piercing member being electrically connected to a different one of three metallic contact pins carried by, and extending from, said contact-carrying portion; and a different conductor-locating means associated with each recess and comprising a pair of relatively movable jaws having mutually confronting surfaces intermediate first and second ends of the jaws configured to receive between them and grasp an insulated electrical conductor when urged together and guiding means incorporated in said jaws for guiding the piercing member of said associated recess along a line or plane of demarcation between the jaws extending from their first end and inwardly to the center of the insulated conductor along a direction such that when said jaws are inserted into said associated recess and advanced into the recess the piercing member contacts said line or plane of demarcation at the first end of the jaws and will move between, and parallel to, the adjacent walls of the jaws into the center of the conductor to make electrical contact therewith, the walls of the recess exerting a camming action with respect to the jaws to urge them together and to grasp the conductor prior to piercing of the outside of the insulation by the piercing member and during the piercing of the conductor.

* * * * *